US008232922B2

(12) United States Patent
Ammann et al.

(10) Patent No.: US 8,232,922 B2
(45) Date of Patent: Jul. 31, 2012

(54) ULTRA WIDE BAND ANTENNA WITH A SPLINE CURVE RADIATING ELEMENT

(75) Inventors: Max Ammann, Mount Merrion (IE); Matthias John, Leipzig (DE)

(73) Assignee: Dublin Institute of Technology, Dublin (IE)

( * ) Notice: Subject to any disclaimer, the term of this patent is extended or adjusted under 35 U.S.C. 154(b) by 624 days.

(21) Appl. No.: 12/355,592

(22) Filed: Jan. 16, 2009

(65) Prior Publication Data

US 2009/0189825 A1 Jul. 30, 2009

Related U.S. Application Data

(60) Provisional application No. 61/023,502, filed on Jan. 25, 2008.

(51) Int. Cl.
*H01Q 1/38* (2006.01)

(52) U.S. Cl. ..... 343/700 MS; 343/846

(58) Field of Classification Search ..... 343/700 MS, 343/846

See application file for complete search history.

(56) References Cited

U.S. PATENT DOCUMENTS 5,583,517 A 12/1996 Yokev et al.
6,078,289 A 6/2000 Manoogian et al.
6,313,783 B1 11/2001 Kuntman et al.
6,914,573 B1 * 7/2005 McCorkle ..... 343/767
7,091,909 B2 * 8/2006 Nakano et al. ..... 343/700 MS
7,352,333 B2 * 4/2008 McCorkle ..... 343/767
2001/0050638 A1 * 12/2001 Ishitobi et al. ..... 343/700 MS

OTHER PUBLICATIONS

Liang, Jianxin et al., Study of a Printed Circular Disc Monopole Antenna for UWB Systems, IEEE Transactions on Antennas and Propagation, Nov. 2005, pp. 3500-3504, vol. 53, No. 11.

Angelopoulos, Evangelos, S. et al., Circular and Elliptical CPW-Fed Slot and Microscope-Fed Antennas for Ultrawideband Applications, IEEE Antennas and Wireless Propagation Letters, 2006, pp. 294-297, vol. 5.

Karacolak, Tutku et al., A Double-Sided Rounded Bow-Tie Antenna (DSRBA) for UWB Communication, IEEE Antennas and Wireless Propagation Letters, 2006, pp. 446-449, vol. 5.

Chen, Zhi Ning et al., Planar Antennas, IEEE Microwave Magazine, Dec. 2006, pp. 63-73.

Chen, Horng-Dean et al., Band-Notched Ultra-Wideband Square Slot Antenna, Microwave and Optical Technology Letters, Dec. 2006, pp. 2427-2429, vol. 48, No. 12.

* cited by examiner

*Primary Examiner* — Hoang V Nguyen
(74) *Attorney, Agent, or Firm* — Nydegger & Associates

(57) ABSTRACT

The present application relates to microstrip-fed printed planar antennas and in particular to the geometry of same. More particularly an antenna is provided with a radiating or ground plane element having a generally continuous curved shape and being symmetrical about the longitudinal axis and non-symmetrical about an axis transverse to the longitudinal axis.

28 Claims, 4 Drawing Sheets

ULTRA WIDE BAND ANTENNA WITH A SPLINE CURVE RADIATING ELEMENT

This application claims the benefit of U.S. Provisional Patent Application Ser. No. 61/023,502, filed Jan. 25, 2008.

FIELD OF THE INVENTION

The present application relates to printed planar antennas and in particular to the geometry of same.

BACKGROUND OF THE INVENTION

In telecommunications, several types of printed monopole antennas are known. Typically, these antennas are fabricated by etching the antenna element pattern in a metal trace bonded to an insulating dielectric substrate with a metal layer bonded to the opposite side of the substrate which forms a groundplane. Printed monopole antennas are also relatively inexpensive to manufacture and design because of the simple 2-dimensional physical geometry. They are usually employed at UHF and higher frequencies because the size of the antenna is directly tied to the wavelength at the resonance frequency.

Geometries of ultra wide band (UWB) antennas, having a bandwidth of at least 25% of the center frequency, have to date generally been based on simple geometric elements, such as rectangles (H. D. Chen, J. N. Li and Y. F. Huang, "Band-notched ultra-wideband square slot antenna," Microwave and Optical Technology Letters, vol. 48(12), pp. 2427-2429, December 2006), circles (J. Liang, C. C. Chiau, X. Chen and C. G. Parini, "Study of a printed circular disk monopole antenna for UWB systems," IEEE Trans. Antennas & Propag., vol. 53(11), pp. 3500-3504, November 2005), or ellipsis (E. S. Angelopoulos, A. Z. Anastopoulos, D. I. Kaklamani, A. A. Alexandridis, F. Lazarakis and K. Dangakis, "Circular and elliptical CPW-fed slot and microstrip-fed antennas for ultrawideband applications," IEEE Antennas Wireless Propag. Lett., vol. 5, pp. 294-297, 2006) or even a combination of these (Z. N. Chen, M. J. Ammann, X. Qing, X. H. Wu, T. S. P. See and A. Cai, "Planar antennas: Promising solutions for microwave UWB applications," Microwave Magazine, vol. 7(6), pp. 63-73, December 2006).

Other shapes are also known (T. Karacolac and E. Topsakal, "A double-sided rounded bow-tie antenna (DSRBA) for UWB communication," IEEE Antennas Wireless Propag. Lett., vol. 5, pp. 446-449, 2006.)

Existing designs are, however, difficult to adjust as the parameters are confined by the geometrical constrains of a circular or elliptical disk and the difficulty of combining simple geometric elements.

SUMMARY OF THE INVENTION

These and other problems are addressed by an antenna having a radiating element provided on a planar surface with a ground plane element also provided on a planar surface. In this combination, at least the radiating element has a geometry defined by a spline curve. In this way the radiating element will have a generally continuous curved shape. In a first arrangement the resultant geometry provides the radiation element having a shape which is disposed along a longitudinal axis of the antenna, the radiating element being symmetrical about the longitudinal axis and non-symmetrical about an axis transverse to the longitudinal axis. A suitable feed line may be provided to provide a feed to the radiating element. The ground plane element may also be defined by a similar geometry.

The planar surface of the radiating element may define a first planar surface and the planar surface for the ground plane element may define a second planar surface. The antenna may further comprise a dielectric substrate defining the first and second planar surfaces.

Suitably, the antenna is a wide band antenna or an ultra wide band antenna. The bandwidth of the antenna may be greater than 25% of the center frequency of operation of the antenna.

Suitably, the shape of the radiating element is definable by a spline curve. This spline curve may be a quadratic Bézier spline curve. The spline curve may be defined by a number of control points. In one arrangement, there are eight control points in total, though any arrangement having three or more control points is useful within the present context.

Where two or more Bézier curves are employed, the series or set of quadratic Bézier curves may be defined by an equation given by:

$$B_n(t) = (1-t)^2\begin{bmatrix} P_{vnx} \\ P_{vny} \end{bmatrix} + 2t(1-t)\begin{bmatrix} P_{nx} \\ P_{ny} \end{bmatrix} + t^2\begin{bmatrix} P_{vn+1x} \\ P_{vn+1y} \end{bmatrix};$$

$$t \in [0, 1],\ n \in [0, 7]$$

where $P_{vn}$ is the 'virtual' control point before $P_n$ and $P_{vn+1}$ is the 'virtual' control point after $P_n$. In case of the eight control points arrangement, the last virtual control point, i.e. n=7, the next control virtual control point $P_{vn+1}$ is the initial virtual control point $P_{v0}$. It will be appreciated that the nature of the equation is such that the resulting spline curve does not pass through any of the endpoints Pn.

The antenna may be generally ovoid or leaf like in shape.

There may also be provided in accordance with the present teaching a method of manufacturing an antenna comprising the steps of selecting a required design criteria, selecting a plurality of control points, establishing a plurality of curved splines employing the control points so as to define at least a radiating element and optionally a ground plane element, and adjusting the control points to obtain an optimal radiation element meeting the required design criteria. Suitably, the number of control points is three or more. Such a method may be employed to design both the radiating element and the ground plane element.

The method may further comprise the steps of printing the obtained optimal radiating element and a ground plane element to provide an antenna. A feed may also be provided to the radiating element. The curved splines are desirably of the type known as Bézier curved splines. The step of adjusting the control points may employ an optimization technique. A suitable optimization technique is a genetic algorithm. Such a method is particularly suitable for manufacturing a wide band or ultra wide band antenna.

A further arrangement provides a wide band printed antenna comprising a radiating element provided on a planar surface, a ground plane provided on a planar surface, and wherein the radiating element is disposed along a longitudinal axis, with the radiating element having a generally continuous curved shape and being symmetrical about the longitudinal axis and non-symmetrical along an axis transverse to the longitudinal axis and wherein the shape of the radiating element is definable by a series of spline curve segments.

These and other features will now be described with reference to illustrative exemplary arrangements which are provided to assist in an understanding of the teaching of the present invention but are not to be considered as limiting the scope of the present invention to that described.

BRIEF DESCRIPTION OF THE DRAWINGS

The present application will now be described with reference to the accompanying drawings in which.

DESCRIPTION OF THE PREFERRED EMBODIMENTS

Figure 1:
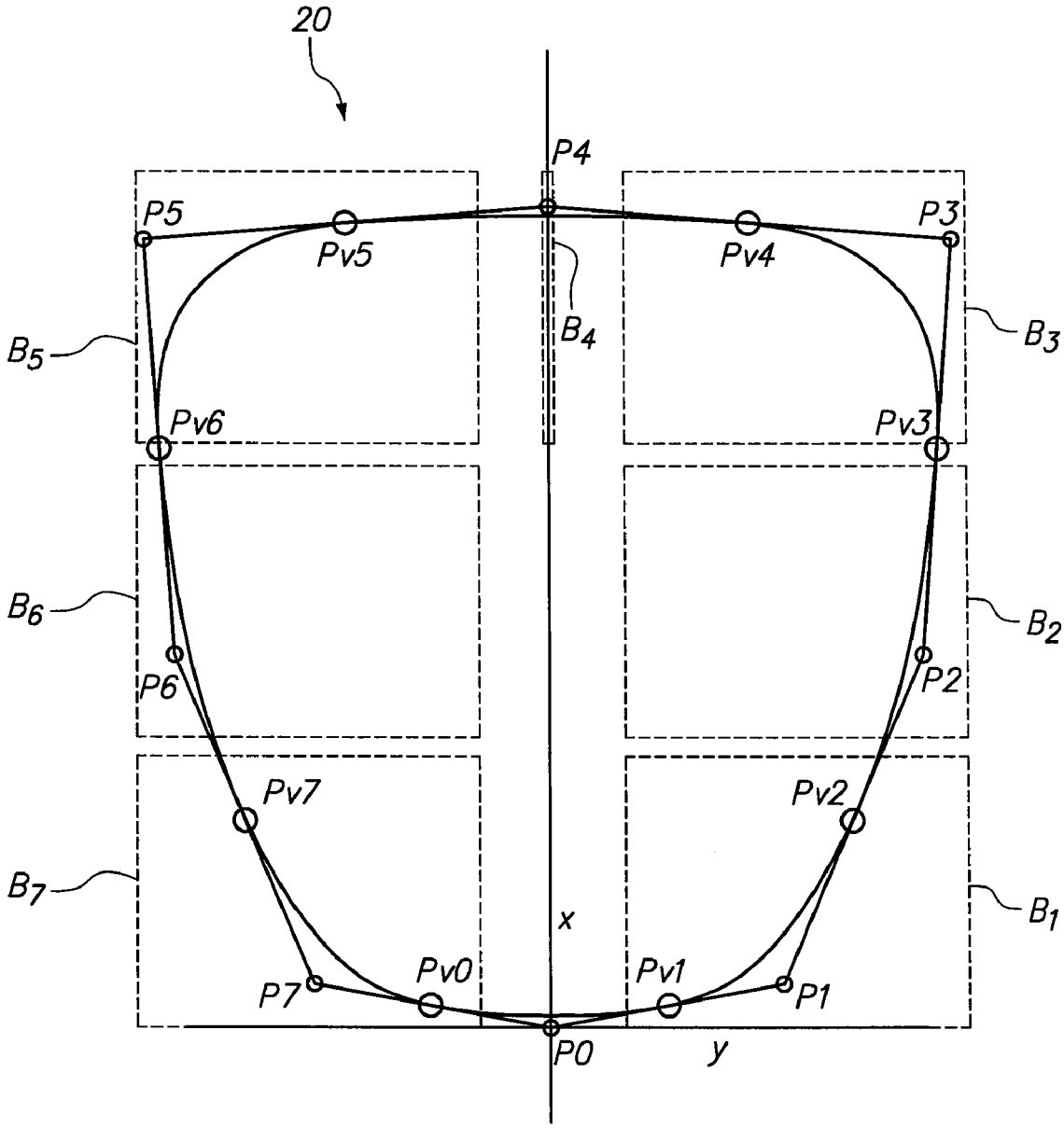
FIG. 1 illustrates a Bézier spline outline of a radiating element of an antenna in accordance with one aspect of the present application.
Figure 2:
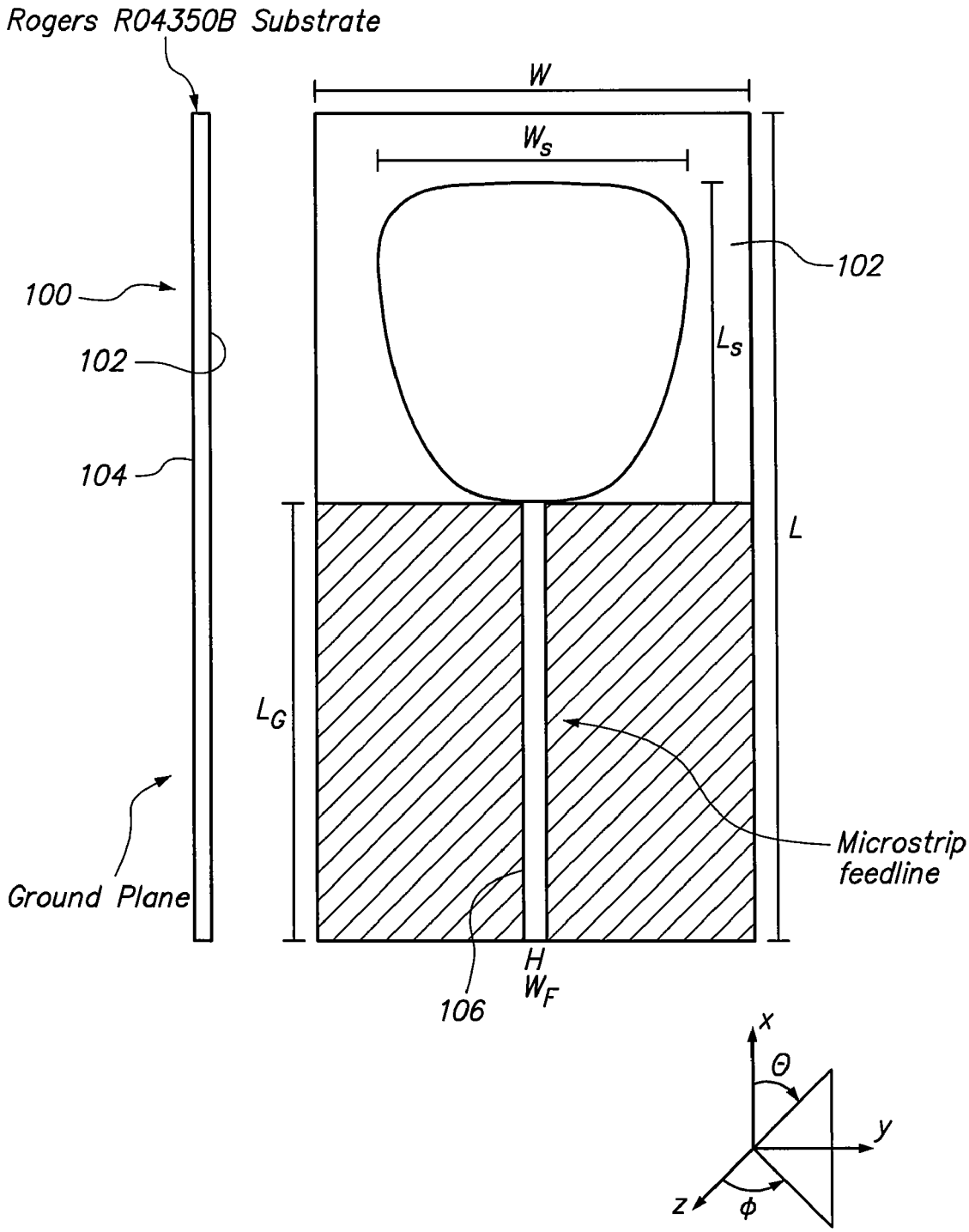
FIG. 2 illustrates an exemplary antenna having a radiating element design of FIG. 1.

The present application provides a wide band or ultra wide band antenna 100, an example of which is shown in FIG. 2, with a radiating element 102 having a geometry 20 based on quadratic Bézier curves (splines) as shown in FIG. 1. Splines are curves generated by quadratic interpolation between control points.

The antenna 100 comprises a radiating element 102, a ground plane element 104 and a feedline 106. The feedline and radiating element are provided on a planar first surface with the ground plane provided on a planar opposing surface. Suitably, the first and second planar surfaces may be provided on opposing sides of a dielectric substrate or on the same side (i.e. as a coplanar waveguide fed CPW). The feedline and radiating element are disposed along a longitudinal axis. The radiating element is suitably a curved shape suitably continuous. The radiating element is suitably symmetrically shaped about the longitudinal axis. The radiating element is suitably non-symmetrical about a planar axis transverse to the longitudinal axis.

The shape of the radiating element is defined by a spline curve with the resulting benefit that the radiating element has an inherently curved shape. Suitably, the outline of the radiating element is described by a quadratic Bézier spline curve. In any event, the spline curve is defined by a number of control points. In the example shown in FIG. 1, there are eight control points $P_0$-$P_7$ from which a resulting curve for a radiating element is suitably defined. There may be more than eight control points, however the computational load would increase.

It will be appreciated that a co-ordinate system is employed which sets the initial control point ($P_0$), or input of the strip feed (typically a 50Ω microstrip line) to the radiating element, at co-ordinates (0,0) in a reference plane defined by the surface of the radiating element with x and y co-ordinates, where the x co-ordinates are co-ordinates along the longitudinal axis and the y co-ordinates are orthogonal to same. It will be appreciated that this initial control is fixed at this location.

An end point $P_4$ is also provided on the x axis (i.e. y=0) at a distance corresponding to the length of the radiating element from the initial control point ($P_0$). It will be appreciated that in the design optimization process, discussed below, this end point is constrained to the y axis and the only parameter for optimization of this end point is the x value. A first set of control points $P_1$-$P_3$ are defined on the left hand side of the longitudinal axis by their x- and y-coordinates with a second set of control points providing mirrored values on the right hand side of the longitudinal axis. The control points $P_1$ to $P_7$ may be provided with initial values which are subsequently optimized during the design process. Alternatively, as discussed below random values may be assigned in an initial step.

The control points result in the creation of a radiator with x-axis symmetry and provides quasi-omnidirectional radiation patterns in the H-plane (y-z plane). The low-frequency resonant modes yield omnidirectional properties irrespective of the symmetry, but the higher modes can be traveling wave modes.

The process of creating the radiator design may employ any suitable modeling software or process to determine optimum values. The present applicants have employed the CST Microwave Studio modeling software provided by Computer Simulation Technology of Darmstadt Germany, which is a 3D full wave electromagnetic solver tool based on the finite integration technique. It will be appreciated that other modeling techniques and software may also be employed to determine optimum values for the positioning of the control points. In order to achieve a closed curve in CST Microwave Studio, the curve is suitably constructed in the following way.

Initially, a 'virtual' control point $P_{vn}$ is placed in the middle of a line defined between each two control points, thus the virtual control point $P_{v0}$ is placed between control point $P_0$ and $P_1$. For each pair of adjacent 'virtual' control points, a quadratic Bézier curve is than generated. The tangent on each of these 'virtual' endpoints is the same for the two curves that meet there, so that a smooth transition between adjacent curve segments is ensured.

The expression defining the set of quadratic Bezier curves may be given by:

$$B_n(t) = (1-t)^2\begin{bmatrix} P_{vnx} \\ P_{vny} \end{bmatrix} + 2t(1-t)\begin{bmatrix} P_{nx} \\ P_{ny} \end{bmatrix} + t^2\begin{bmatrix} P_{vn+1x} \\ P_{vn+1y} \end{bmatrix};$$

$$t \in [0, 1],\ n \in [0, 7]$$

where $P_{vn}$ is the 'virtual' control point before $P_n$ and $P_{vn+1}$ is the 'virtual' control point after $P_n$. In case of the last virtual control point, i.e. n=7, the next control virtual control point $P_{vn+1}$ is the initial virtual control point $P_{v0}$. It will be appreciated that the nature of the equation is such that the resulting spline curve does not pass through any of the endpoints $P_n$.

An advantageous positioning of the control points is then determined by applying an optimization routine which optimizes the position of the control points in order to achieve particular design criteria. Design objectives could include: bandwidth, lower edge frequency, phase linearity, low group delay, size or any combination of these or other criteria.

Figure 3:
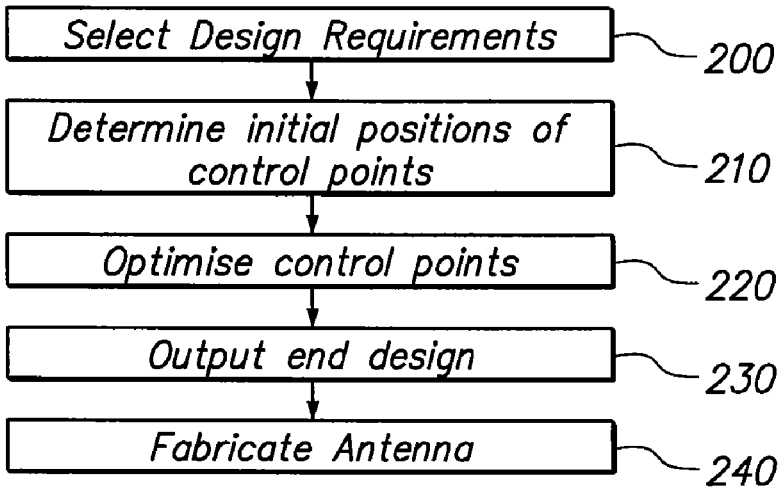
FIG. 3 illustrates a method flow of the manufacture of an antenna of FIG. 2.

An exemplary method of implementation will now be discussed with reference to FIG. 3. The method commences with the selection of the required design parameters (step 200). The method will now be described with reference to the exemplary use of a genetic algorithm (GA) to perform the optimization. A genetic algorithm is a robust stochastic search method, which is based on the principle of natural evolution.

The process beings with the generation of an initial population (values of control points), which is generally chosen randomly (step 210).

An iterative process (step 220) then begins in which the fitness of each individual control point in the population is evaluated. The best individuals are then selected according to fitness function. A new generation of control points is then generated through crossover and mutation (genetic operations), the fitness of the new generation is then evaluated and the process repeated until a desired criteria has been achieved or after a predetermined number of iterations.

During the optimization process, the problem is encoded in binary format e.g. the x and y coordinates of each control point are encoded in binary format. An exemplary genetic algorithm that may be employed would be one that employs single point crossover and tournament selection. Single point crossover is where the chromosome (bit string) of two parents is split at one random point, the pieces are then swapped and two offspring created. Tournament selection is random but according to a probability depending on the fitness. It will be appreciated that other selection and crossover methods are possible. In an exemplary configuration, the mutation rate was 1% and the population size was set to 30 and evolved over 20 generations.

The genetic algorithm suitably only operates on points $P_1$-$P_4$ (as $P_5$-$P_7$ are mirrored). Boundaries are suitably defined to ensure that the resulting antenna design is a realistic one. Thus the boundaries may be selected to ensure, for example, that there is a minimum radiating element size larger than the feedline, a maximum size smaller than the predetermined size of the substrate, no overlapping points and no loops in the spline. Exemplary boundaries for each of the control points $P_1$, $P_2$, $P_3$, $P_5$, $P_6$, $P_7$ comprising rectangular regions $B_1$, $B_2$, $B_3$, $B_5$, $B_6$, $B_7$ are shown in outline form in FIG. 1. The boundary $B_4$ for $P_4$ is shown as a region along the longitudinal axis. The x- and y-coordinates of points $P_1$-$P_3$ and the x-coordinate of point $P_4$ are encoded in a binary format. Suitably, these 7 parameters may be encoded to only 35 bits. It will be appreciated that this is a very small search space considering the complexity of the resulting geometry.

For an exemplary design, the design aim consisted of two goals. The first goal was selected to optimize for a wide band between 0 & 20 GHz; this goal was given a weighting of 70%. The second goal was to reduce the lower edge frequency; this second goal was weighted at 30%. The FDTD (Finite Difference Time Domain) simulation software returns the $S^{11}$ (return Loss) as a list of 1000 frequency points. The fitness function was as follows:

$$\text{fitness}=0.7\cdot BW+0.3\cdot(1000-f_{LE}) \text{ where}$$

$$BW=\sum_{n=0}^{1000}(S^{11}(n)\leq -10\,\text{dB})$$

and $f_{LE}$=point of lower edge frequency i.e. the smallest n where the return loss $S^{11}(n)\leqq -10$ dB.

An exemplary final geometry optimized by the GA in response to the exemplary goals selected is shown in FIG. 2. It can be seen that the element curves away smoothly from the feed point. The maximal possible height is exploited as point P5 is placed 35 mm away from the feed point. In the case of these exemplary goals, the computational time needed for the 600 evaluations amounted to approximately 4 days on a single computer, although of course it will be appreciated that such time is reflective of the computing power of the specific computer used as opposed.

Once, the antenna geometry has been designed (step 240), the antenna may be fabricated using conventional techniques (step 230). In the present case, the antenna was printed on a conventional antenna substrate (e.g. a Rogers microwave laminate RO4350B of 0.762 mm thickness, er=3.48 and tand=0.0037). In the exemplary structure, the substrate has a size of w=45 mm by l=85 mm with the groundplane located on the rearside. The dimension of the groundplane is lg=45 mm square. The antenna is fed by a wf=2.5 mm microstrip feedline. The dimensions of the spline based radiating element are ls=33 mm by ws=32 mm.

Figure 4:
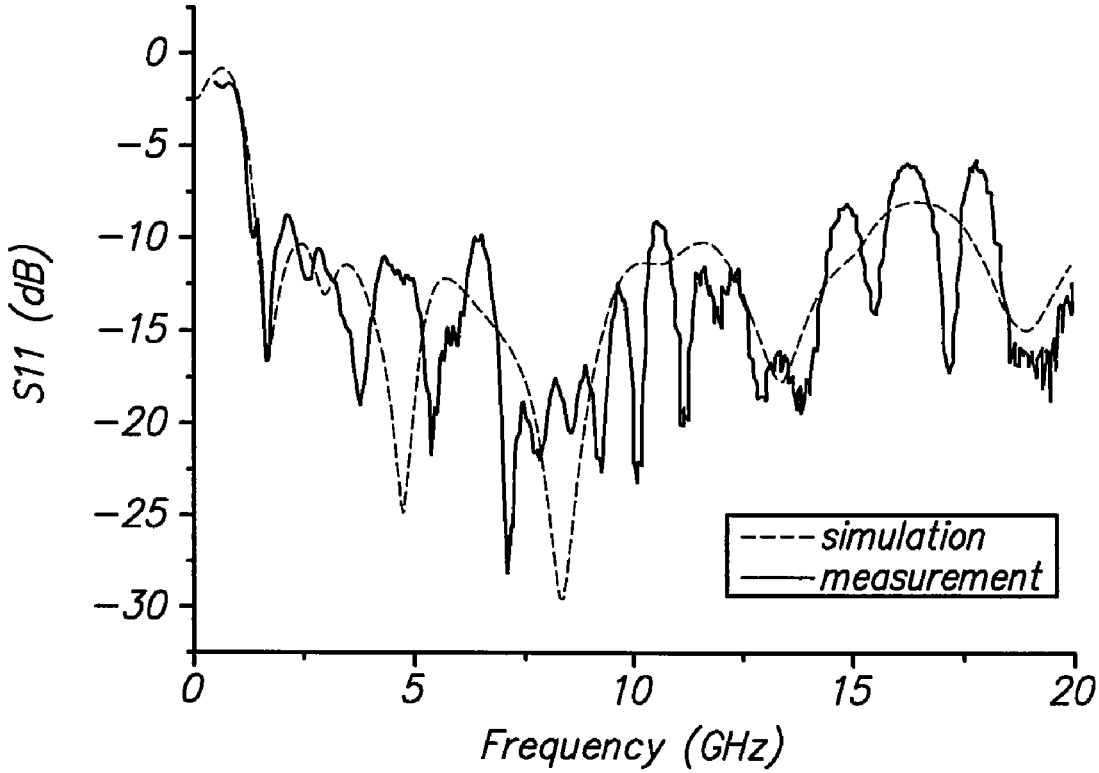
FIG. 4 illustrates simulated and measured return losses for the exemplary antenna of FIG. 2.
Figure 5:
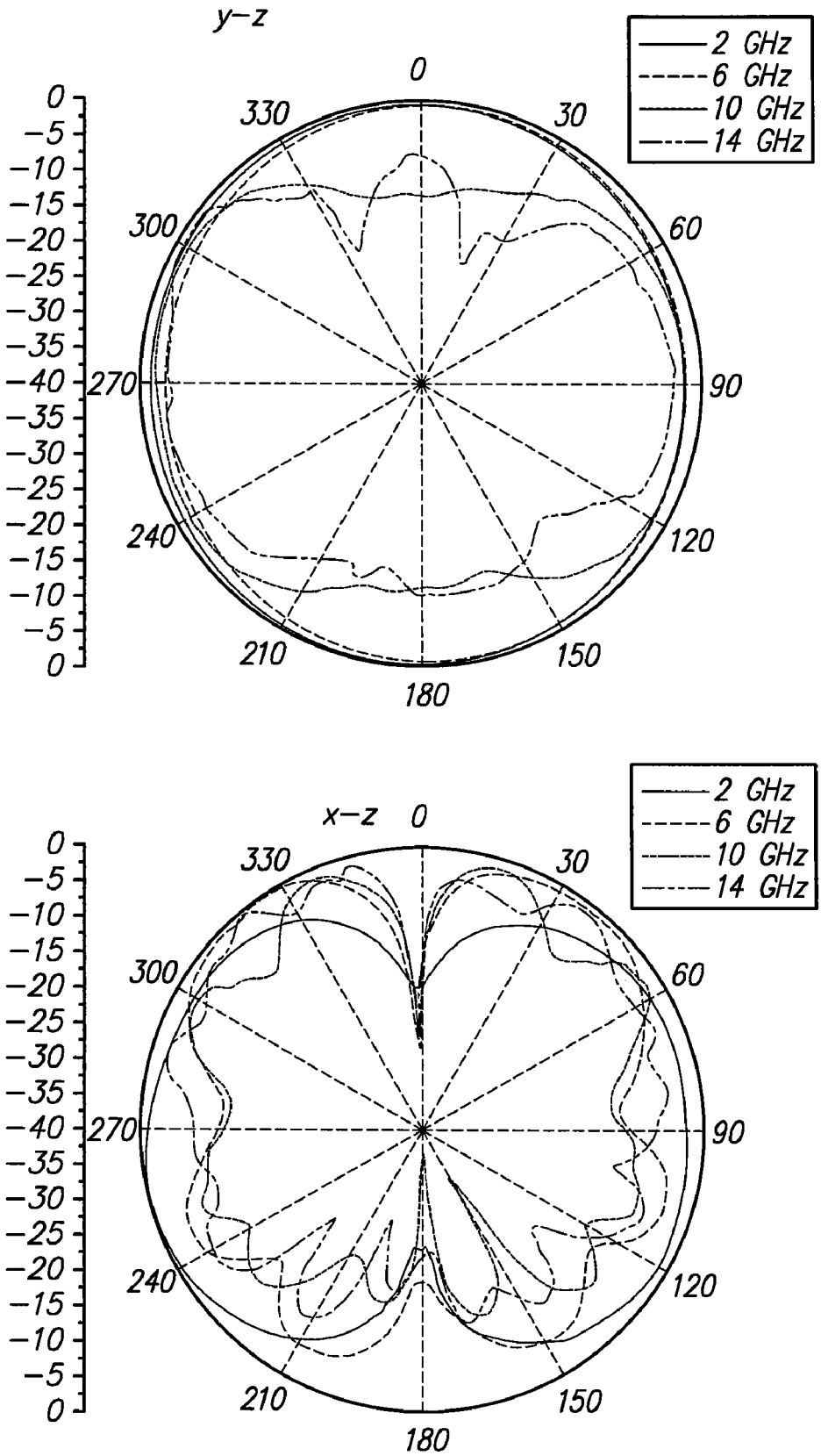
FIG. 5 illustrates measured radiation patterns in the y-z, and x-z planes for the exemplary antenna of FIG. 2.

Experimental and simulated results for this exemplary antenna design are shown in FIG. 4. It can be seen that the measured return loss is greater than 10 dB from 1.44 GHz to 14.7 GHz. This is an impedance bandwidth ratio of 10.2:1, which it will be appreciated by those skilled in the art is very wide for a printed monopole. Measured radiation patterns are shown in FIG. 5. The H-plane patterns are omnidirectional up to about 8 GHz. The gain is 2.8 dBi at 2 GHz, 4.3 dBi at 6 GHz, 4.8 dBi at 10 GHz and 5.3 dBi at 14 GHz. The radiation efficiency at these frequencies is 91%, 96%, 92% and 89% respectively. It will be appreciated that this resulting antenna design is suitable for a wide variety of applications including, for example, multimode use in the higher cellular, WLAN and UWB systems. The method for designing antennas described herein is particularly suited to wideband and ultra wideband antennas (where the bandwidth is 25% or more of the center frequency).

Although the present application has been explained with reference to an exemplary printed planar antenna, it will be appreciated that the techniques described herein may also be applied to coplanar waveguide (CPW) fed antennas as well. Thus, the present application is not intended to be restricted to the example above and extends to planar dipole as well as monopole type antennas with printed transmission line feeds. Thus for example, the present application is intended to cover microstrip, CPW and other feeds and also dipole style printed antennas. It will therefore be understood that what has been described herein are exemplary techniques and antenna arrangements. While such methods and structures are useful to assist in an understanding of the present teaching, it will be understood that it is not intended that the teaching of the present invention be limited in any way except as may be deemed necessary in the light of the appended claims. While advantageous arrangements and implementations have been described, modifications can be made to the heretofore described without departing from the spirit and scope of the present invention.

Similarly, while the above exemplary embodiment has been described with reference to designing the radiating element, it will be appreciated that the design method may also be applied to the design of the ground plane and so the application also extends to a ground plane designed using the above method.

The words comprises/comprising when used in this specification are to specify the presence of stated features, integers, steps or components but does not preclude the presence or addition of one or more other features, integers, steps, components or groups thereof.

What is claimed is:

1. An antenna comprising:

a radiating element provided on a planar surface;

a ground plane element provided on a planar surface; and wherein at least the radiating element has a shape defined by a spline curve, wherein the shape of the radiating element and ground plane element is definable by a spline curve.

2. The antenna of claim 1 wherein the radiating element is disposed along a longitudinal axis, the radiating element having a generally continuous curved shape and being symmetrical about the longitudinal axis and non-symmetrical about an axis transverse to the longitudinal axis.

3. An antenna according to claim 1, wherein the radiating element is provided on a first planar surface and the ground plane element is provided on a second planar surface, the antenna further comprising a dielectric substrate defining the first and second planar surfaces.

4. An antenna according to claim 1, wherein the antenna is a wide band antenna.

5. An antenna according to claim 1, wherein the antenna is an ultra wide band antenna.

6. An antenna according to claim 1, wherein the antenna has a bandwidth greater than 25% of the center frequency of the antenna.

7. An antenna according to claim 1, wherein the spline curve is a quadratic Bézier spline curve.

8. An antenna according to claim 7, wherein the expression defining the quadratic Bézier curve is given by:

$$B_n(t) = (1-t)^2\begin{bmatrix} P_{vnx} \\ P_{vny} \end{bmatrix} + 2t(1-t)\begin{bmatrix} P_{nx} \\ P_{ny} \end{bmatrix} + t^2\begin{bmatrix} P_{vn+1x} \\ P_{vn+1y} \end{bmatrix};$$

$$t \in [0, 1],\ n \in [0, N]$$

where $P_{vn}$ is a 'virtual' control point placed in the middle of a line defined between two control points $P_n$ and $P_{n+1}$ and N is the number of control points and $P_{N+1}$ is $P_0$.

9. An antenna according to claim 1, wherein the spline curve is defined by a number of control points.

10. An antenna according to claim 9, wherein the number of control points is equal to three or more.

11. An antenna according to claim 1, wherein the antenna is generally ovoid or leaf like in shape.

12. An antenna according to claim 1 provided on a flexible substrate.

13. An antenna according to claim 1 having a folded body.

14. An antenna according to claim 1 wherein each of the radiating element and the ground plane element have a shape defined by a spline curve.

15. An antenna according to claim 1 wherein the antenna has a body, the radiating element and ground plane element being provided on opposing sides of the body.

16. An antenna according to claim 1 is a printed monopole antenna.

17. An antenna according to claim 1 wherein the radiating element has a shape defined by a plurality of spline curves.

18. An antenna comprising;

a radiating element provided on a planar surface;

a ground plane element provided on a planar surface; and wherein at least the radiating element is disposed along a longitudinal axis of the antenna and has a generally continuous curved shape, the shape being symmetrical about the longitudinal axis and non-symmetrical about an axis transverse to the longitudinal axis, wherein at least the radiating element has a shape defined by a spline curve, wherein said spline curve is a quadratic Bézier spline curve.

19. A method of manufacturing an antenna comprising the steps of selecting a required design criteria;

selecting a plurality of control points;

establishing a plurality of curved splines employing said control points so as to define at least a radiation element shape; and adjusting the control points to obtain a radiation element meeting the required design criteria, wherein the radiation element shape and a ground plane element shape are defined using a plurality of curved splines.

20. A method of manufacturing, an antenna according to claim 19, wherein the number of control points is three or more.

21. A method of manufacturing an antenna according to claim 19, further comprising the step of printing the obtained radiation element.

22. A method according to claim 21 further comprising the step of providing a feed to the radiation element.

23. A method according to claim 19, wherein the curved splines are Bézier splines.

24. A method according to claim 19, wherein the step of adjusting the control points employs an optimization technique.

25. A method according to claim 24, wherein the optimization technique is a genetic algorithm.

26. A method according to claim 19 where the antenna is a wide band or ultra wide band antenna.

27. A wide band printed antenna comprising:

a radiating element provided on a first planar surface;

a ground plane provided on a second planar surface; and wherein at least the radiating element is disposed along a longitudinal axis, with the radiating element having a generally continuous curved shape and being symmetrical about the longitudinal axis and non-symmetrical along an axis transverse to the longitudinal axis and wherein the shape of the radiating element is definable by a series of quadratic Bézier spline curves.

28. An antenna comprising:

a radiating element provided on a first planar surface;

a ground plane element; and wherein the radiating element is disposed along a longitudinal axis of the antenna, with the radiating element and ground plane having a generally continuous curved shape being symmetrical about the longitudinal axis and non-symmetrical about an axis transverse to the longitudinal axis.

* * * * *